US005240318A

United States Patent [19]

Schröder et al.

[11] Patent Number: 5,240,318

[45] Date of Patent: Aug. 31, 1993

[54] DEVICE FOR HOLDING A DRAWER IN AN ARTICLE OF FURNITURE

[75] Inventors: Gerhard Schröder, Bad Oeynhausen; Karl-Volker Faust, Bielefeld; Frank Noske, Minden, all of Fed. Rep. of Germany

[73] Assignee: Paul Hettich GmbH & Co., Kirchlengern, Fed. Rep. of Germany

[21] Appl. No.: 849,442

[22] PCT Filed: Jul. 12, 1991

[86] PCT No.: PCT/DE91/00581

§ 371 Date: May 18, 1992

§ 102(e) Date: May 18, 1992

[87] PCT Pub. No.: WO92/04843

PCT Pub. Date: Apr. 2, 1992

[30] Foreign Application Priority Data

Sep. 17, 1990 [DE] Fed. Rep. of Germany ... 9013161[U]

[51] Int. Cl.[5] ..... A47B 88/00

[52] U.S. Cl. ..... 312/319.1; 292/78

[58] Field of Search ..... 312/319.1, 330.1, 333, 312/334.46; 292/78

[56] References Cited

U.S. PATENT DOCUMENTS

| | | | |
|---|---|---|---|
| 930,534 | 8/1909 | Cox | 292/78 |
| 3,666,342 | 5/1972 | Biesecker | 292/78 |
| 3,713,681 | 1/1973 | Worley | 292/78 |
| 3,782,800 | 1/1974 | Remington et al. | 312/333 |
| 4,268,076 | 5/1981 | Itoi | 312/333 |
| 4,596,427 | 6/1986 | Pflugfelder | 312/319.1 |

FOREIGN PATENT DOCUMENTS

| | | |
|---|---|---|
| 0391221 | 10/1990 | European Pat. Off. . |
| 1262533 | 3/1968 | Fed. Rep. of Germany . |
| 8907511 | 8/1989 | Fed. Rep. of Germany . |

*Primary Examiner*—Kenneth J. Dorner
*Assistant Examiner*—Janet M. Long
*Attorney, Agent, or Firm*—Peter K. Kontler

[57] ABSTRACT

A device for holding a drawer closed includes a fork-like member which is pivotable between an inoperative position and an operative position. When the drawer is open, the fork-like member is normally in the inoperative position. As the drawer is closed, a pin on the drawer engages a first tine of the fork-like member to thereby pivot the latter to the operative position in which the pin is engaged by a second tine of the fork-like member. The second tine biases the pin under the action of a spring so as to hold the drawer closed. A returning member is integral with the fork-like member and serves to return the fork-like member to the inoperative position if the fork-like member is unintentionally pivoted to the operative position while the drawer is open. The returning member is provided with a channel having a first open end adjacent to the fork-like member and a second open end which faces the pin when the drawer is open and the fork-like member is in the operative position. The second open end has a resilient closure which permits entry of the pin into the channel but serves as a barrier to withdrawal of the pin. Upon closing the drawer, the pin enters the channel through the second open end. When the drawer is subsequently opened, the pin abuts the closure thus causing the returning member to pivot the fork-like member towards its inoperative position. The pin leaves the channel of the returning member via the first open end after the fork-like member reaches the inoperative position.

22 Claims, 4 Drawing Sheets

DEVICE FOR HOLDING A DRAWER IN AN ARTICLE OF FURNITURE

BACKGROUND OF THE INVENTION

The present invention relates to a device for holding a drawer in an article of furniture.

Devices of this type serve, on the one hand, to cushion a drawer to be inserted during the last insertion stage and, on the other hand, to hold a drawer to be inserted in a terminal position such that it can only be withdrawn by overcoming a resilient force, albeit small.

To this end, it is known to mount a fork component on the side of the drawer while the pin which the fork component is affixed to the side wall of a furniture article.

It is here necessary to the spacing between the corresponding side of the drawer and the side wall of the furniture article relatively precisely. Otherwise, there will be malfunctions, i.e., the pin will be too short or too long so that it is either unable to engage the fork component altogether or projects in too far with the result that operation is not possible.

In this connection, a given dependence of certain guide rails is also to be considered as disadvantageous. The corresponding components of these guide rails are affixed to the drawer, on the one hand, and to the furniture article, on the other hand, and the guide rails can only be selected taking into account the pin length or the pin length must be adjusted to their dimensional characteristics.

In any event, a construction of the device which can be employed without restriction for all usable guide rails is not possible.

In practice, the situation can arise that the fork component is unintentionally pivoted to a holding position before the drawer is pushed into a holding position, that is, before engagement of the pin in the fork opening, so that the pin cannot engage the fork opening when the drawer is closed.

SUMMARY OF THE INVENTION

It is an object of the present invention to design a device of this type in such a manner that, using means of the greatest structural simplicity, the utility of the device is improved, a reliable return of the fork component is assured and the overall life of the device is increased.

This object is achieved by a holding device having a return mechanism provided with a guide channel which is open at two sides and extends approximately parallel to the fork opening. One opening of the guide channel is adjacent the fork opening while the other opening is closable by a resilient locking bar which opens towards the guide channel.

For one, the invention allows the device to be arranged on the underside with the pin secured to the drawer while the fork component with the connected return mechanism can, for example, be secured to a support rail which is fastened to the furniture article.

Accordingly, no requirements exist as regards tolerances and guide rail type so that the use of the device has no influence on the mounting and employment of guide rails.

A particularly advantageous embodiment of the invention provides for the return mechanism and the fork component to be constructed as plastic part and to lie in the interior of a housing having a slot which is open at one side. The common pivot pin of the fork component and the return mechanism lies in the slot.

This structural embodiment makes possible a particularly simple manufacture of the overall device since especially the assembly thereof, that is, the mounting of the fork component and the return mechanism in the slot, requires very little expenditure.

BRIEF DESCRIPTION OF THE DRAWINGS

Exemplary embodiments of the invention are described below with reference to the accompanying drawings.

There is shown.

DESCRIPTION OF THE PREFERRED EMBODIMENTS

Figure 1:
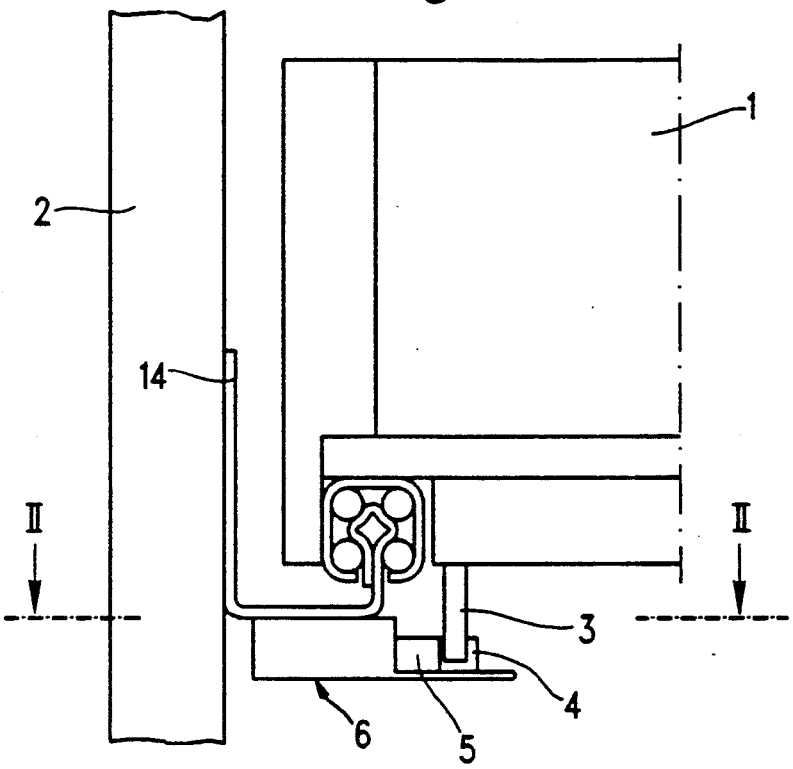
FIG. 1 a front view of the mounted device of one embodiment in mounted condition, FIGS. 2–4 plan views of the device in different working positions according to the section line II—II of FIG. 1, FIG. 5 a plan view of a detail of the device, FIG. 6 a plan view of a further detail of the device, FIG. 7 a plan view of another detail of the device illustrated in FIGS. 2–4, and FIG. 8 a plan view of an additional exemplary embodiment of the device.
Figure 2:
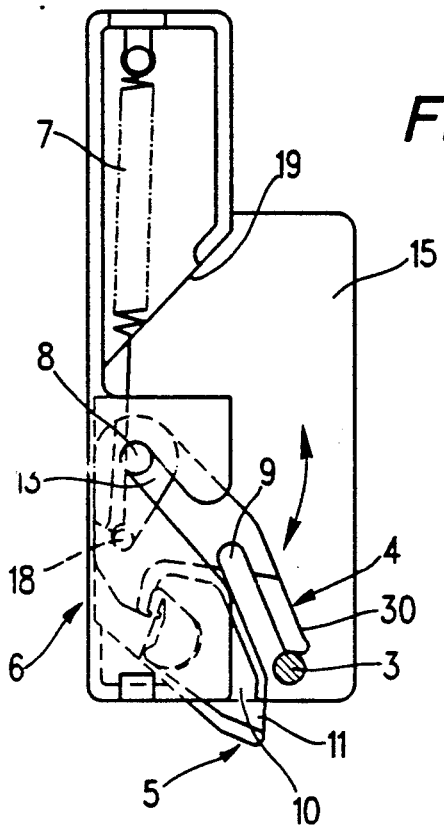
Figure 3:
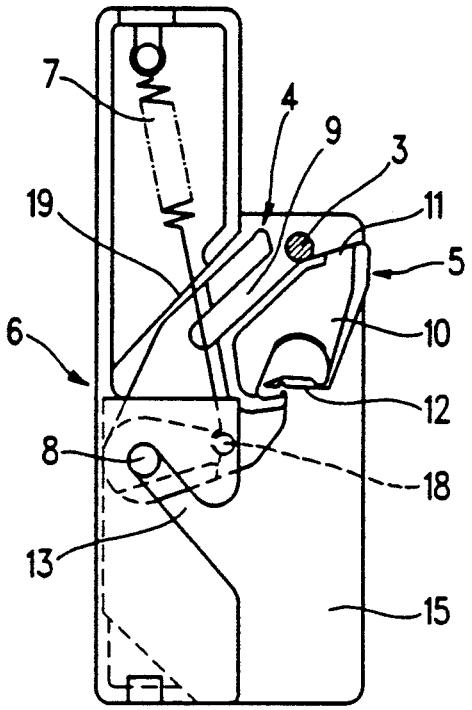
Figure 4:
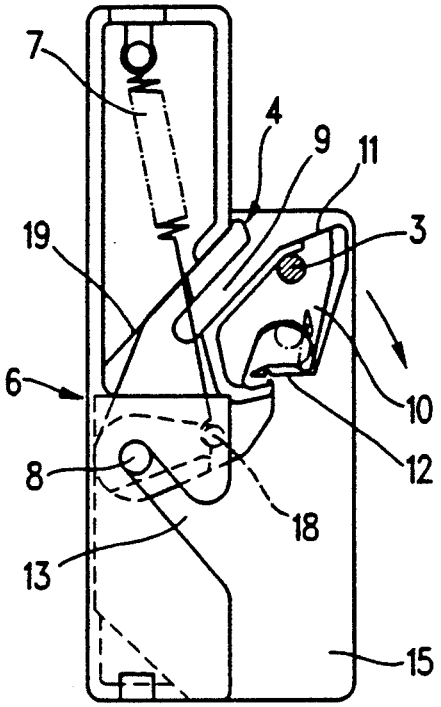
Figure 6:
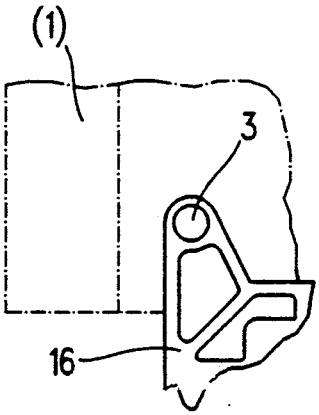
Figure 8:
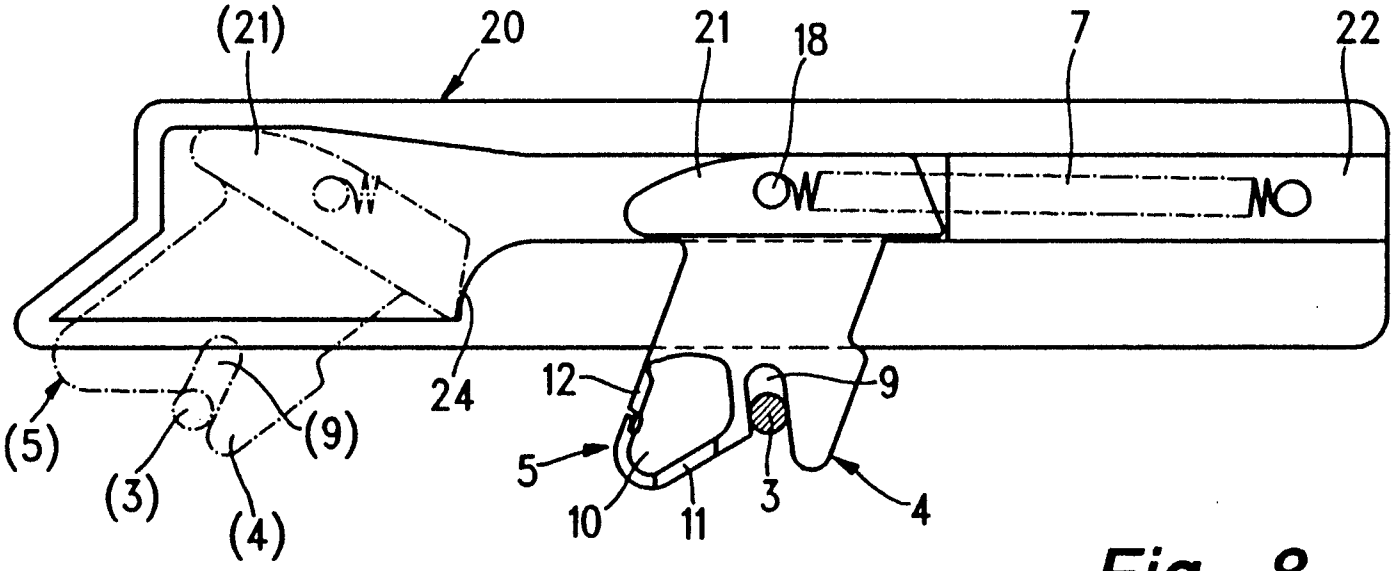

A device for holding a drawer in an article of furniture is illustrated in FIGS. 2–4 and, with reference to another exemplary embodiment, in FIG. 8. The device is mounted in accordance with FIG. 1.

The drawer 1 is supported on a guide rail 14 for longitudinal displacement in a furniture article 2 in a manner known per se.

A pin 3 is secured at the underside of the bottom of the drawer 1 and, in the position of use, corresponds to a fork component or holding member 4 which is pivotally arranged in a housing 6. This housing 6, in turn, is secured to the underside of the guide rail 14. While the pin 3 can be moved back-and-forth with the drawer 1, the housing 6 is fixed.

A slot 13 is provided at the upper side, facing the drawer 1, in a pocket-shaped cutout of the housing 6. The slot 13 runs at an inclination counter to the direction of insertion of the drawer 1 and serves as a pivot bearing for a pivot pin 8 with which the fork component 4 is arrested. A tension spring 7 acting in the direction of insertion of the drawer 1 is affixed to the housing 6, on the one hand, and is hung on a lug 18 of the fork component 4, on the other hand.

In the idle position of the fork component 4 illustrated in FIG. 2, the lug 18 is arranged on the side of the pivot pin 8 facing away from the spring coil. In the starting position shown in FIG. 2, the pin 3 initially encounters the fork component 4 at the inlet region of the fork opening 9 upon insertion of the drawer 1 and bears against the fork leg 30.

Upon further insertion of the drawer 1, the pin 3 pushes against the corresponding fork leg so that the fork component 4 pivots about the pivot pin 8. During the pivoting procedure, the pin 3 enters the fork opening 9.

Insertion of the drawer 1 is assisted by the spring action of the spring 7. In a terminal position as shown in FIG. 3, the pin 3 lies against the side of the fork component opposite the fork leg.

The fork component 4 remains under the tension of the tension spring 7 since the drawer 1 already lies against an end abutment whereas the fork component 4 has not completed a maximum possible pivot movement. This assures that, even with tolerances, the drawer always lies in the closed position.

A return mechanism or returning member 5 is arranged next to the fork component 4 and is provided with a guide channel 10. The guide channel 10 has an unclosable opening or first open end 11 adjacent to the open side or additional open end of the fork opening 9 and an oppositely disposed inlet opening which is closable by a resilient locking bar or blocking element 12. The locking bar 12, which resembles a flap, can be opened only in a direction towards the guide channel 10 whereas opening in the opposite direction is not possible because the locking bar then abuts the lateral region of the inlet opening.

Figure 7:
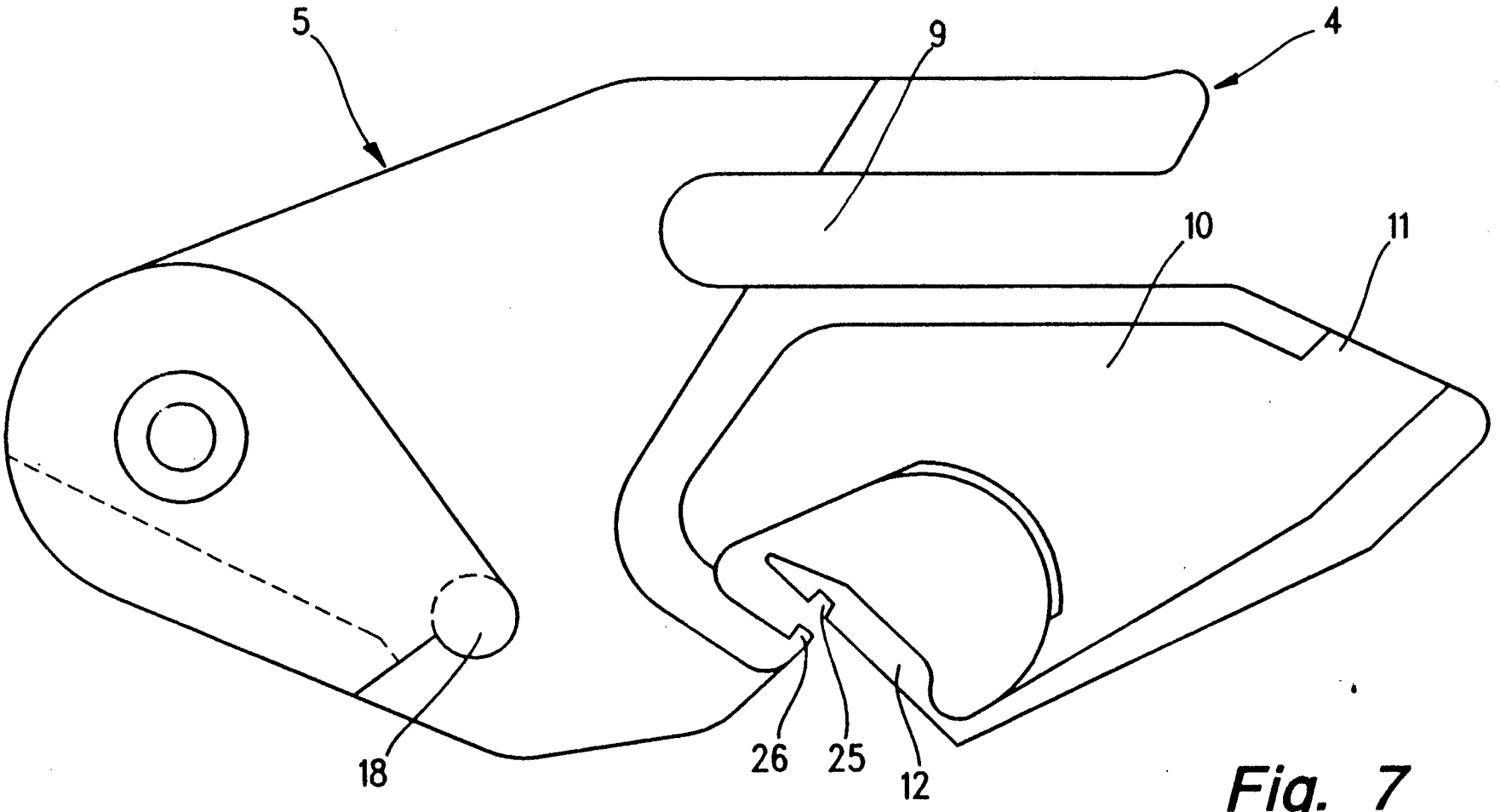

As can be clearly seen from FIG. 7, the side of the free end of the locking bar 12 facing the inlet opening is provided with an arresting recess 25. In the closed position, an arresting nose 26 of the return mechanism 5 complementarily engages the arresting recess 25.

The arresting recess 25 and the arresting nose 26 are designed so that they can absorb lateral forces as always arise upon withdrawal of the drawer. In any event, reliable closing of the locking bar 12 is assured.

The operation of the return mechanism 5 can be particularly clearly seen from FIG. 4.

By unintentional pivoting of the fork component 4 and the return mechanism 5 before introduction of the pin 3 into the fork opening 9, the ability of the fork component 4 to function is nullified.

In order to reestablish this, the drawer 1 is pushed in and the pin 3 is introduced into the guide channel 10 as the locking bar is pressed inwards. This situation is illustrated in FIG. 4 by dash-and-dot lines. When the drawer has been pushed in farther, the resilient locking bar 12 closes the inlet opening of the guide channel 10. Upon subsequent withdrawal of the drawer 1, the pin 3 comes to rest against the inner side of the locking bar 12. Since the latter is now firmly engaged, the fork component is pivoted back in the direction of the arrow until it has reached a terminal position in accordance with FIG. 2.

To arrest the fork component and to improve the possibility of the return, a base plate 15 of the housing 6 is provided with an abutment 19 which is abutted by the fork leg of the fork component 4.

Upon further withdrawal of the drawer 1, the pin 3 is removed through the open side of the guide channel 10 so that the fork component 4 is once again in its starting position.

Figure 5:
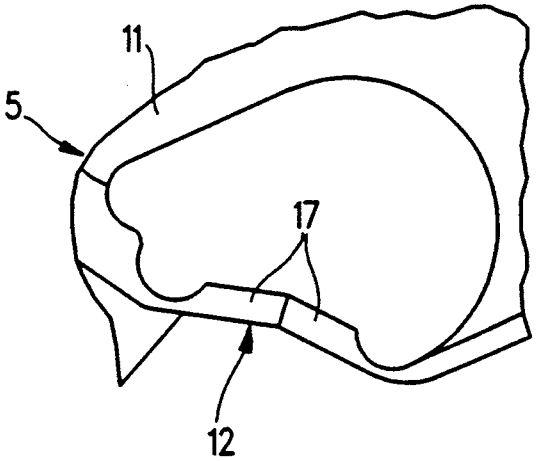

While the locking bar 12 in the exemplary embodiments illustrated in FIGS. 2 to 4, 7 and 8 is articulated at one side by means of a film hinge, another exemplary variation according to FIG. 5 provides two bar parts 17. The bar parts 17, which resemble a pair of flaps, pivot in a wing-like fashion and are sloped on the sides thereof which face each other so that they likewise unblock the opening only in a direction towards the guide channel 10 and in a direction towards the opening 11. These bar parts 17 are also articulated by means of film hinges.

In particularly advantageous manner, the pin 3 can constitute part of an arresting element 16 which is frequently provided to unlock and easily remove, or to release, the drawer from the guide rails 14. This possibility allows the pin to be attached, without additional mounting, at the same time that the arresting element 16 is mounted.

A further exemplary embodiment of the invention is illustrated in FIG. 8. The fork component 4 and the attached return mechanism are connected with a sliding block or carrier 21 which is guided in a slide guide or groove 22 of a housing 20. While, on the one hand, the tension spring 7 is hung on the lug 18 which is arranged on the sliding block 21, it is fixedly connected to the housing, on the other hand.

The starting position of the fork component is illustrated in dash-and-dot lines. The sliding block 21 is here disposed at an inclination in a recess 23 into which the slide guide 22 opens. One side of the sliding block lies against a stop edge 24 and the other side in the extension zone of the slide 22.

Upon pushing in the drawer which is not shown in this exemplary embodiment, the pin 3 presses against the fork leg and the sliding block rotates to such an extent in the recess 23 that it enters the slide guide 22. While the pin 3 is disposed in the fork opening 9, the sliding block 21 the fork component 4 and the return mechanism 5 are drawn into a terminal position together with the drawer.

In the event that the fork component 4 assumes an improper position which affects the ability to function, the return thereof takes place per the operation described with reference to FIG. 4.

The respective housing 6, 20 can be provided with non-illustrated arresting means which make easy mounting on the guide rail 14 possible. The latter is self-evidently provided with arresting components corresponding to the arresting means.

We claim:

1. Device for holding a drawer which is movable between an extended position and a retracted position in the retracted position, comprising holding means including a holding member pivotable between an inoperative position and an operative position; a pin movable with the drawer to pivot said holding member from said inoperative position towards said operative position upon movement of the drawer from the extended position towards the retracted position, said holding means being designed to inhibit movement of said pin towards the extended position when said holding member is in said operative position; and a returning member connected with said holding member for returning said holding member to said inoperative position when said holding member is moved from said inoperative position by other than said pin, said returning member being provided with a channel having a first open end and a second open end which is arranged to be in alignment with said pin when said pin is in the retracted position and said holding member is in a predetermined position other than said inoperative position, said returning member including a blocking element for said second open end, and said blocking element being arranged to permit entry of said pin into but to prevent exit of said pin from said channel through said second open end.

2. The device of claim 1, wherein said holding member is provided with a passage having an additional open end for receipt of said pin, said first open end being located adjacent said additional open end.

3. The device of claim 2, wherein said channel is at least approximately parallel to said passage.

4. The device of claim 3, wherein said first and second open ends are essentially in register with one another.

5. The device of claim 2, wherein said holding member has a fork-like configuration.

6. The device of claim 1, wherein said blocking element is resilient.

7. The device of claim 1, wherein said holding means comprises a biasing member which acts on said holding member and is arranged to urge said pin towards the retracted position when said holding member is in said operative position.

8. The device of claim 1, wherein said holding member and said returning member are integral.

9. The device of claim 8, wherein said holding member and said returning member comprise plastic.

10. The device of claim 1, wherein said blocking element consists of a single flap having a free end and another end which is connected to said returning member.

11. The device of claim 1, wherein said blocking element comprises a pair of flaps arranged to open only in a direction from said second open end towards said first open end.

12. The device of claim 1, further comprising a housing for said holding member and said returning member, and a pivot pin for said holding member, said housing having a lower side and an upper side provided with a slot, and said pivot pin being mounted in said slot.

13. The device of claim 12, wherein said slot has one end which is open and another end which is closed, said slot being inclined to a path between the extended and retracted positions of said pin such that said one end is more remote from the retracted position than said other end.

14. The device of claim 1 for use with a rail which can be mounted on an article of furniture to guide the drawer, wherein said holding member and said returning member are mountable on the rail.

15. The device of claim 14 for use with a drawer having a bottom, wherein said pin is mountable on the bottom of the drawer, said holding and returning members being mountable on the rail so as to be disposed below the bottom of the drawer.

16. The device of claim 1, wherein said pin constitutes part of a mounting member for releasably connecting the drawer to a guide rail for the drawer.

17. The device of claim 1, further comprising a housing having a groove which is arranged to extend along a direction between the extended and retracted positions of said pin, and a carrier movable in said groove, said holding and returning members being mounted on said carrier.

18. The device of claim 17, wherein said housing further has a recess and said groove opens to said recess, said recess being provided with means for arresting said carrier such that said holding member is in said inoperative position.

19. The device of claim 17, wherein said holding means comprises a biasing member which is connected to said housing and acts on said carrier so as to urge said pin towards the retracted position when said holding member is in said operative position.

20. The device of claim 1, wherein said returning member comprises at least one film hinge for mounting said blocking element on said returning member.

21. The device of claim 1, wherein said blocking element has a closed position, said returning member being provided with a depression and a complementary projection, and one of said depression and projection being provided on said blocking element, said projection being receivable in said depression when said blocking element is in said closed position.

22. The device of claim 21, wherein said blocking element is provided with said depression.

* * * * *